US006168284B1

(12) United States Patent
Wacker et al.

(10) Patent No.: US 6,168,284 B1
(45) Date of Patent: Jan. 2, 2001

(54) LIGHTING APPARATUS FOR A SEWING MACHINE

(75) Inventors: Niklaus Wacker; Andreas Spring, both of Steckborn; Christian Anderegg, Frauenfeld, all of (CH)

(73) Assignee: Fritz Gegauf Aktiengesellschaft, Steckborn (CH)

( * ) Notice: Under 35 U.S.C. 154(b), the term of this patent shall be extended for 0 days.

(21) Appl. No.: 09/314,423

(22) Filed: May 18, 1999

(30) Foreign Application Priority Data

Jun. 5, 1998 (CH) ..... 01219/98

(51) Int. Cl.[7] ..... D05B 79/00

(52) U.S. Cl. ..... 362/90; 362/216; 362/217; 362/287; 112/1

(58) Field of Search ..... 362/90, 216, 217, 362/287; 112/1, 258, 259, 270

(56) References Cited

U.S. PATENT DOCUMENTS

| | | | | |
|---|---|---|---|---|
| 1,955,284 | * | 4/1934 | Goosman | 362/90 |
| 2,677,042 | * | 4/1954 | Peets et al. | 362/90 |
| 4,747,024 | * | 5/1988 | Guthier | 362/90 |
| 4,841,415 | * | 6/1989 | Dobner | 362/90 |
| 5,089,943 | * | 2/1992 | Wolfelschneider | 362/216 |
| 5,105,118 | * | 4/1992 | Shinada et al. | 313/51 |
| 5,448,460 | * | 9/1995 | Belfer et al. | 362/225 |

* cited by examiner

*Primary Examiner*—Alan Cariaso
*Assistant Examiner*—Ronald E. Delgizzi
(74) *Attorney, Agent, or Firm*—Edwin D. Schindler

(57) ABSTRACT

A lighting apparatus for a sewing machine having a lamp holder, which retains at least one lamp, is arranged on the underside of the head of a sewing machine, and within the range of the needle bar and the presser foot bar. The lamp is constructed to loop around the needle bar and the presser foot bar over an angular range of more than 180°. The type of lamp used is, preferably, a cold-light-cathode florescent lamp, which radiates little, if any, heat, while emitting a pleasant light.

11 Claims, 3 Drawing Sheets

LIGHTING APPARATUS FOR A SEWING MACHINE

BACKGROUND OF THE INVENTION

1. Technical Field of the Invention

The present invention relates, generally, to a lighting apparatus for a sewing machine.

More particularly, the present invention relates to a lighting apparatus for a sewing machine, having a lamp holder for retaining at least one lamp arranged on the underside of the head of the sewing machine, within the range of the needle bar and the presser foot bar. The lamp loops around the needle bar and the pressure foot bar over an angular range of more than 180°.

2. Description of the Prior Art

Room lighting in homes and on commercial premises is generally found to be inadequate for sufficiently illuminating the work field around a sewing machine and, particularly, within the area of the needle. Devices are known to the prior art by which the work field can be illuminated directly. Light bulbs are arranged for this purpose on the head of the sewing machine.

A lighting device is described in U.S. Pat. No. 4,413,310, wherein an incandescent lamp is arranged with vertical adjustability within the head laterally of the needle and presser foot bars. Such an incandescent light is quite capable of fully illuminating the work site within the range of lighting of the lamp. However, the drawback in this type of lighting device is that the needle bar and the bar of the presser foot cause shadows to be cast in precisely the stitching area of the needle.

Additionally, a lighting device is known to the prior art from Federal Republic of Germany patent application No. 35 25 698, which comprises two rod-shaped luminous elements, which are arranged on the side of the needle or presser foot bar. It is possible with this tandem arrangement to realize relatively good illumination of the work site. However, mounting two luminous elements and their electrical feeds requires a great deal of space that is not otherwise available on a sewing machine. The luminous elements, therefore, need to be arranged very close to the work area, i.e., are very close to the support of the sewing stock, which constantly poses the risk that the slightest inattentiveness on the part of the seamstress will cause the latter to come into contact with the hot surface of the luminous elements and suffer burns. Furthermore, working within the range of the high level of heat radiated from such lamps can be quite uncomfortable.

SUMMARY OF THE INVENTION

It is, therefore, an object of the present invention to provide a lighting device for a sewing machine, which permits a complete lighting of the work site, particularly the stitching area of the needle, without casting shadows and without posing a hazard to the seamstress, or other persons, in the area.

The foregoing and related objects are accomplished by the lighting apparatus for a sewing machine of the claimed invention, in which a lamp holder, which retains at least one lamp, is arranged on the underside of the head of a sewing machine, and within the range of the needle bar and the presser foot bar. The lamp is constructed to loop around the needle bar and the presser foot bar over an angular range of more than 180°. Preferably, the type of lamp used is a cold-light-cathode florescent lamp, which substantially radiates little, if any, heat, while emitting a pleasant light.

More particularly, the use of a tubular, curved lamp, which surrounds the needle bar and the presser foot bar, at least, within an angular range of 180°, permits mounting of such a lamp within a very small space below the head of the sewing machine, while supplying it with energy.

The use of a cold-light-cathode fluorescent lamp ("CFL-lamp") supplies a bright and pleasant light and causes almost unmeasurable heat radiation. This makes it possible to mount the lamp in very close proximity to the sewing machine housing and, further, to install the lamp so that it is able to curve around the needle and presser foot bar in an arc of close to 360°.

Reflectors can be used and may be made of plastic with a reflecting coating, which can be manufactured and installed at a very favorable cost.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
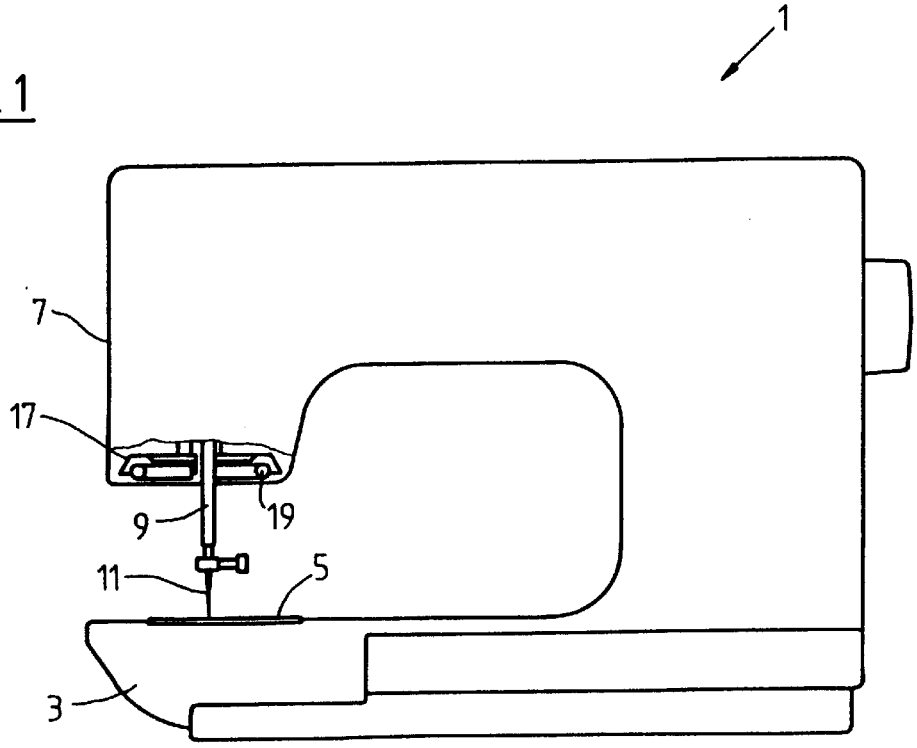
FIG. 1 is a side view of a sewing machine.
Figure 2:
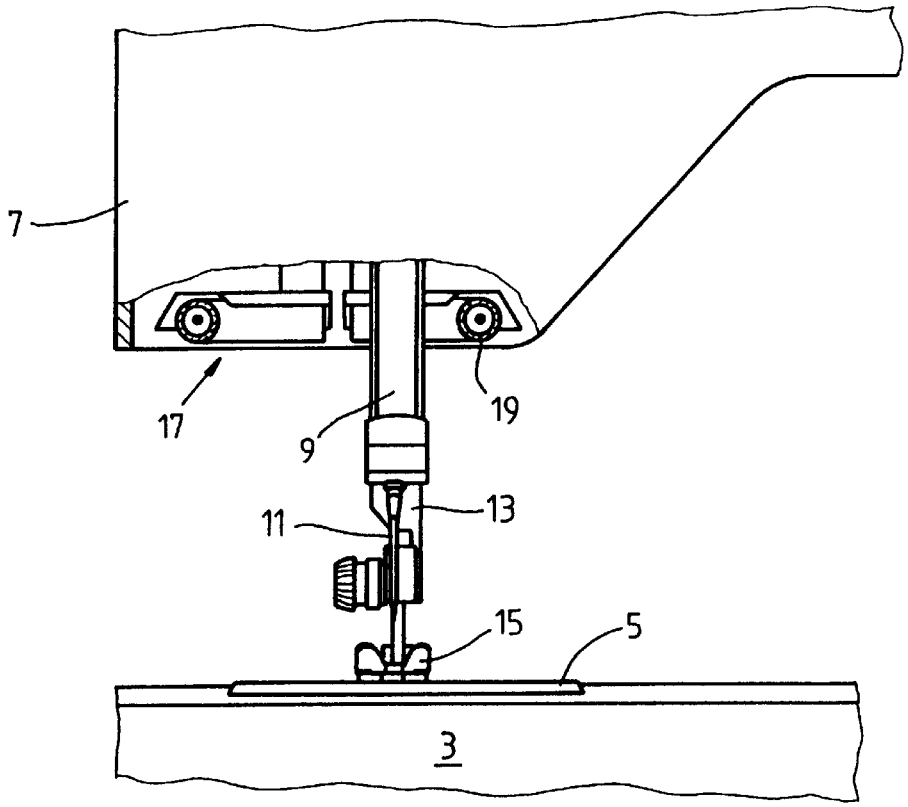
FIG. 2 is an enlarged representation of the head of the sewing machine.

Turning now, in detail, to an analysis of the accompanying drawing figures, FIG. 1 shows the contours of a sewing machine 1, with a lower arm 3, receiving a catcher system (not shown.) The top side of said system forms a working surface 5. The drives and guides for needle bar 9 with needle 11 and for the presser foot bar 13, which supports presser foot 15, are accommodated in head 7. The drives and guides are not shown, because such features are sufficiently known from the prior art, and their structures have no influence on the lighting system of the present invention. The lower zone of head 7 of sewing machine 1 is shown "cut open" in FIGS. 1 and 2 in order to make the details of lighting device 17 visible. The lighting device, if not inserted in head 7, can be mounted on the latter at the bottom.

Lighting apparatus 17 comprises, at least, one lamp or a luminous element 19, which loops around needle bar 9 and presser foot bar 13 over an angular range of, at least, 180° and, preferable, close to 360°. Lamp 19 has a tubular structure and, preferably, operates based upon the principle of cold-light-cathode fluorescence. Such lamps are known and commercially available under the trade name "CFL-lamps." Such lamps are employed in electronic equipment as background lighting devices.

Figure 3:
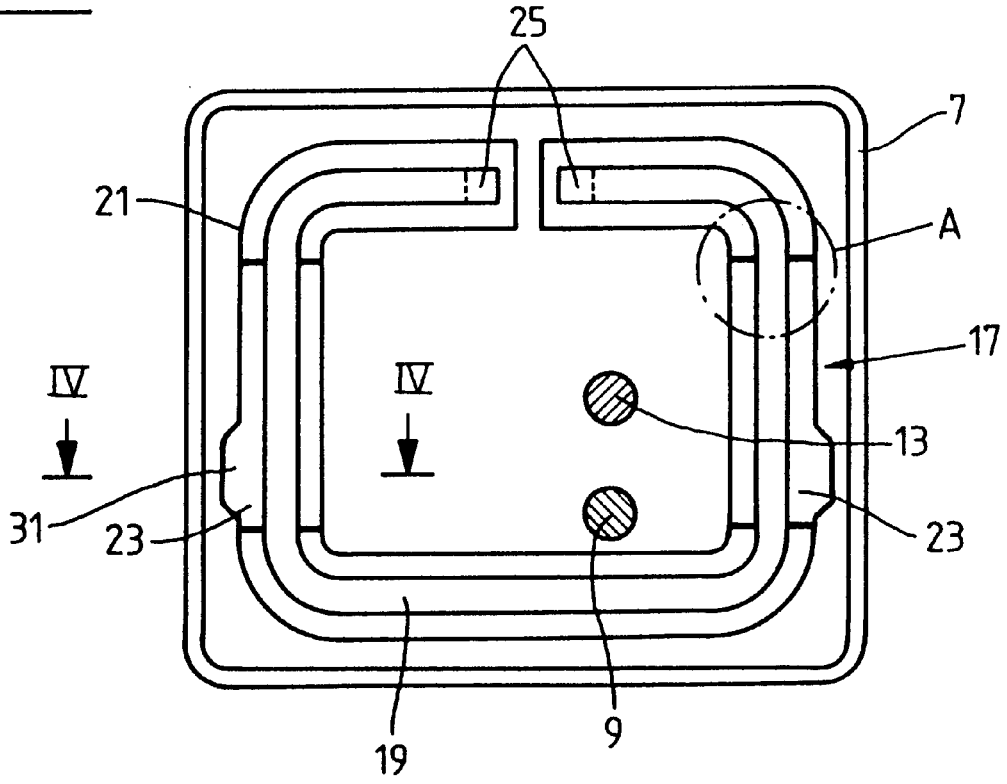
FIG. 3 is a view of the head of the sewing machine from below.
Figure 4:
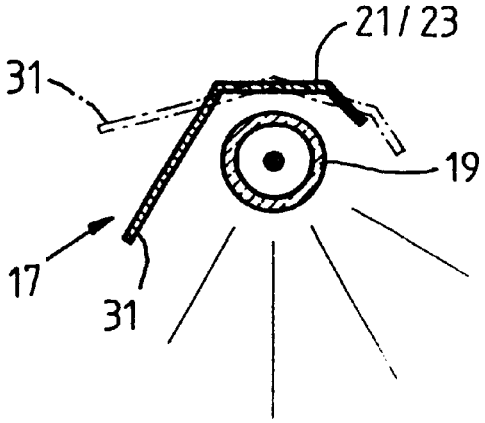
FIG. 4 is a cross-sectional view through the lighting apparatus of the present invention, taken along the line IV—IV of FIG. 3.
Figure 5:
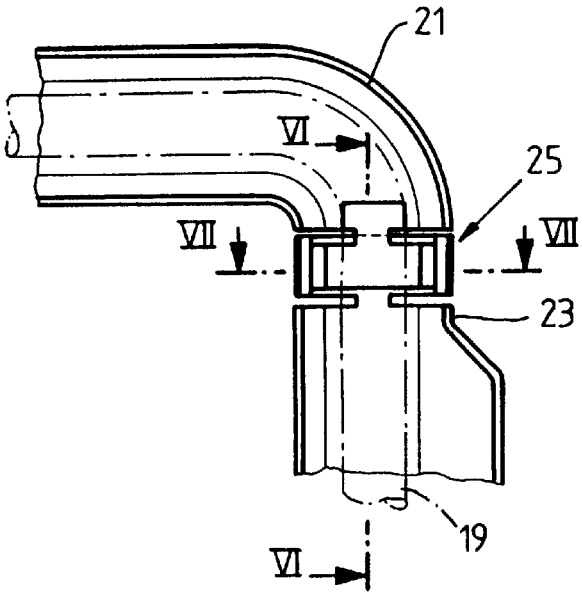
FIG. 5 shows an enlarged cutout "A" taken from FIG. 3.
Figure 6:
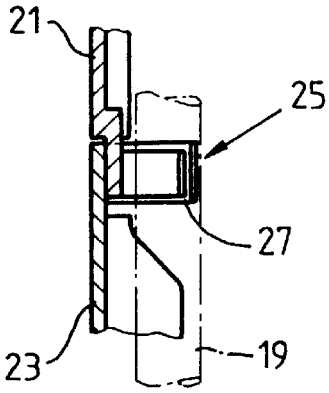
FIG. 6 is a cross-sectional view taken along the line VI—VI in FIG. 5.
Figure 7:
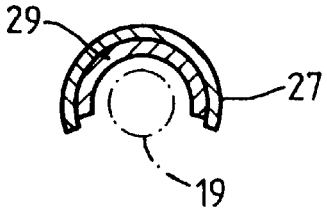
FIG. 7 is a cross-sectional view taken along the line VII—VII in FIG. 5; and, FIG. 8 shows an enlarged representation of the handle element of FIG. 5.
Figure 8:
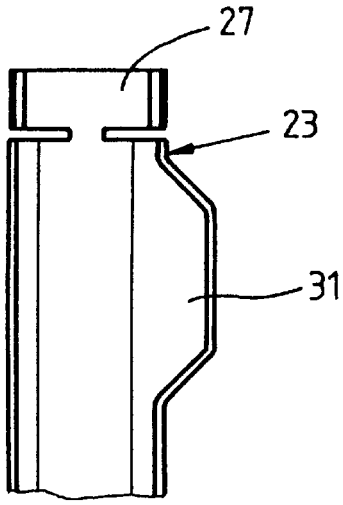

In a first embodiment of the present invention, as illustrated in FIG. 3, lamp 19 is arranged on a lamp holder 21, which is designed reflectively above lamp 19 (e.g., for reflecting the light of the lamp onto the work surface 5 within the range of the presser foot 15 and the point of the needle 11), and which may have sections 23, whose positions are adjustable or pivotable. The two ends 25 of tubular lamp 19 are provided with plug connections, which are arranged extending perpendicular to the expanse of lamp 19, thereby forming the electrical connection. At the same time, said connections may serve as mounting means on lamp holder 21. Lamp 19, consequently, can be plugged into lamp holder 21 in a simple manner without requiring the use of any tools. Lamp holder 21 comprises matching plug receptacles (not shown in the drawing figures), which are connected to a current source located in sewing machine 1.

Alternatively, the ends 25 of lamp 19 can be provided with connection cables, which are connected to the current source via conventional means.

Lamp 19, preferably, has a shape adapted to the contour of head 7 of sewing machine 1. Therefore, it extends, in most cases, in a rectangular form, whereby the two ends 25 of lamp 19 are disposed, spaced apart, to just such an extent that when lamp 19 is inserted or replaced, such spacing will suffice for passing presser foot bar 13 and needle bar 9 through such spacing. Of course, it is also possible to assemble lamp 19 from two U-shaped, or semicircular, components, so that a substantially uninterrupted annular emission of light is realized around needle 11.

The adjustable sections 23 may be articulated on lamp holder 21 in order to illuminate certain areas of work surface 5, with greater or lesser intensity. For this purpose, the swinging sections 23 are connected on lamp holder 21 by means of plastic sheet or conventional hinges.

FIGS. 5 to 8 show a preferred design of a hinge 25, by which the swinging sections 23 and the stationary sections 21 are joined with each other. A cylinder jacket-shaped section 27 is formed by injection molding on the ends of the movable, pivoting sections 23; said sections 27 receiving a cylinder jacket-shaped section 29, the latter being secured on the stationary section 21. The two assembled cylinder jacket-shaped components 27, 29 jointly form a bearing supporting the rotation of the swinging section 23. A flap- or tab-shaped handle part, or gripping means, 31 may be formed by molding on the swinging section 23 for adjusting the latter.

Alternatively, the entire lamp holder 21 may be connected with head 7 of sewing machine 1 in an articulated manner, and the position of lamp 19, with respect to work surface 5, can be adjusted or changed by suitable setting means, for example, a setscrew.

While only several embodiments of the present invention have been shown and described, it will be obvious to those skilled in the art that many modifications may be made to the present invention without departing from the spirit and scope thereof.

What is claimed is:

1. A lighting apparatus for a sewing machine, comprising a lamp holder with a lamp, said lamp holder being arranged on a bottom side of a head of a sewing machine, said sewing machine having a needle bar and a presser foot bar, the lamp looping around the needle bar and the presser foot bar over an angular range of more than 180°.

2. The lighting apparatus for a sewing machine according to claim 1, wherein said lamp holder retains a plurality of lamps.

3. The lighting apparatus for a sewing machine according to claim 1, wherein the lamp loops around the needle bar and the presser foot in an uninterrupted arrangement over more than 180°.

4. The lighting apparatus for a sewing machine according to claim 1, wherein the lamp comprises a tubular luminous element extending in an arc, with ends of said tubular luminous element being connectable to an electric energy source in the sewing machine.

5. The lighting apparatus for a sewing machine according to claim 1, wherein the lamp comprises a tubular luminous element assembled from straight sections, with ends of said tubular luminous element being connectable to an electric energy source in the sewing machine.

6. The lighting apparatus for a sewing machine according to claim 1, wherein the lamp extends in a substantially rectangular shape.

7. The lighting apparatus for a sewing machine according to claim 1, wherein the lamp extends in a substantially circular shape.

8. The lighting apparatus for a sewing machine according to claim 1, wherein a portion of said lamp holder is constructed as a reflector for reflecting light from the lamp onto a work surface within the range of the presser foot and a point of the needle.

9. The lighting apparatus for a sewing machine according to claim 8, wherein said lamp holder includes at least one swinging section and further comprising gripping means provided on at least one of said swinging sections for adjusting and positioning reflected light.

10. The lighting apparatus for a sewing machine according to claim 1, wherein said lamp holder has at least one section which is pivotable.

11. The lighting apparatus for a sewing machine according to claim 1, wherein said lamp holder includes at least one swinging section and at least one stationary section, with at least one of the swinging sections having cylinder, jacket-shaped cups mounted on its ends for receiving cylindrical lugs on at least one of the stationary sections.

* * * * *